United States Patent [19]

Reddy

[11] 4,275,664

[45] Jun. 30, 1981

[54] STEP-PLATFORM OPERATION

[75] Inventor: Redreddy S. Reddy, Skokie, Ill.

[73] Assignee: Vapor Corporation, Chicago, Ill.

[21] Appl. No.: 79,031

[22] Filed: Sep. 26, 1979

[51] Int. Cl.[3] ..... B61D 23/02

[52] U.S. Cl. ..... 105/430; 105/426; 105/432; 105/435; 105/447; 105/450; 280/166

[58] Field of Search ..... 105/426, 427, 429–432, 105/434, 435, 437, 438, 447, 448, 450; 280/163, 164 R, 166; 296/62; 182/88, 89, 91, 95

[56] References Cited

U.S. PATENT DOCUMENTS

| | | | |
|---|---|---|---|
| 1,141,064 | 5/1915 | Kunzelman | 105/430 |
| 1,183,707 | 5/1916 | Winegarden | 105/430 |
| 1,419,992 | 6/1922 | Szczurek | 105/430 |
| 1,425,149 | 8/1922 | Swanson et al. | 105/430 |
| 2,162,964 | 6/1939 | Nichols | 105/447 X |
| 2,220,035 | 10/1940 | Brack | 105/430 |
| 3,724,396 | 4/1973 | Roth | 105/450 X |
| 3,795,205 | 3/1974 | Gritchen et al. | 105/450 |
| 3,913,497 | 10/1975 | Maroshick | 105/447 |
| 3,955,827 | 5/1976 | Wonigar | 105/447 X |
| 3,957,284 | 5/1976 | Wright | 280/166 |

*Primary Examiner*—Randolph A. Reese
*Attorney, Agent, or Firm*—Francis J. Lidd

[57] ABSTRACT

A step-platform operator 17 for transit vehicles for driving a step 19 and a platform 18 between open and closed positions, includes a reversible drive motor 42 driving the step and platform through a lever and linkage for providing differential motion between step and platform during the last portion of the closing cycle and the initial portion of the opening cycle and allowing a mechanical interlock between step and platform in fully closed position. Both platform and step are driven from a single drive unit. Additionally, the lever and linkage assembly utilizes the weights of the platform and the step to counterbalance each other and allow the use of a low power reversible drive motor to power the system.

8 Claims, 12 Drawing Figures

23
22
19
36
63
62
59
60
57
25
42
24
51
28
50
46
48
45
44
43
32

19
31
30
29
28
23
22
51
47
50
56
46
48
57
62
61
59
60
58
36
63
25
24
42
66
45
43
44
67
32
28
51
50
48
OC
46
45
43
44
OC
57
56
48

STEP-PLATFORM OPERATION

DESCRIPTION

This invention relates in general to transit vehicles, and more particularly to the loading and unloading of passengers in a transit vehicle, and still more particularly to a platform and step assembly associated with an opening and having a single operator for driving both the platform and step assembly between closed and open positions to alternately allow both high and low level loading and unloading of passengers.

Heretofore, it has been well known to have folding and storable step assemblies manually operable between usable and non-usable positions for recreational vehicles and the like, as illustrated in U.S. Pat. No. 3,955,827. It has also been known to provide door systems for transit vehicles having high and low level passenger loading and unloading capability. The system in U.S. Pat. No. 3,724,396 includes a stationary step having a door powered to expose or reveal the step and a platform that is manually operable between closed and open positions. The system in U.S. Pat. No. 3,795,205 additionally provides a power driven platform that is movable between usable and non-usable positions. In U.S. Pat. Nos. 3,913,497 and 3,957,284 a pair of doors is power driven for an opening and either exposes a platform or steps for loading and unloading purposes wherein the steps are powered to be converted from the conventional step formation to a platform formation.

It has not been heretofore known to provide a platform and step assembly of the type where the platform is movable between open and closed positions and the step or at least a portion thereof is movable between open and closed positions wherein the drive mechanism for operating the platform and step is connected to the platform and step for simultaneous operation. More importantly, the operator of the invention provides simultaneous operation of the platform and steps during the initial portion of the closing cycle, while allowing differential motion between platform and steps during the last portion of the closing cycle and conversely. Thus there is provided a mechanical lock between platform and steps in the closed position. Further, the step and platform operator of the present invention is capable of counterbalancing the weights of the step and platform so as to permit the use of a small size motor for operating same.

It is therefore an object of the present invention to provide a step-platform operator for controlling the movement of a step and a platform in a transit vehicle to enable the vehicle to efficiently have high and low level passenger loading and unloading capability.

It is a further object of the present invention to have a step-platform operator which utilizes the counterbalancing of the weights of the step and platform to facilitate the operation of the step and platform between usable and non-usable positions and to permit the use of a relatively low power motor for driving the step and platform between open and closed positions.

Another object of the present invention is in the provision of a step-platform operator having double overcenter locking arrangements operable when the step and platform are in closed positions.

Still another object of the present invention is to provide a step-platform operator which may optionally include counterbalancing springs to provide easy and smooth operation during the opening and closing of the step and platform.

An additional object of the invention is to provide a step-platform operator wherein all operating mechanism and linkages are contained in the associated vehicle.

Other objects, features and advantages of the invention will be apparent from the following detailed disclosure, taken in conjunction with the accompanying sheets of drawings, wherein like reference numerals refer to like parts, in which:

FIGS. 9 to 12 show a modified version of the step-platform operator of the present invention utilizing counterbalancing springs, wherein FIG. 9 is a view similar to FIG. 3 in that it shows the parts of the mechanism and the step and platform in open position;

FIG. 10 is a view similar to FIG. 9 but illustrating the step and platform and the associated assembly in closed position;

FIG. 11 is a front elevational view of the step-platform operator illustrated in FIGS. 9 and 10; and FIG. 12 is a detailed view of the linkage associated with the platform to illustrate that linkage and the platform in closed position as contrasted with the showing in FIG. 11.

While the step-platform operator of the present invention is particularly useful for transit vehicles of the type that move on rails, it should be appreciated that they could be used for other types of transit vehicles such as buses or any type of vehicle where it is desired to provide the capability of both high and low level loading and unloading of passengers. Reference will be made in this application principally to loading and unloading of passengers from transit vehicles.

Further, the step-platform operator of the present invention is to be associated with an opening in a vehicle wherein the step-platform operator and its associated components are arranged at the bottom of the opening. Since it is particularly important to many transportation systems that both high and low level loading and unloading of passengers are encountered, the present invention is thereby particularly useful to meet this capability efficiently and in the interest of public safety.

Figure 1:
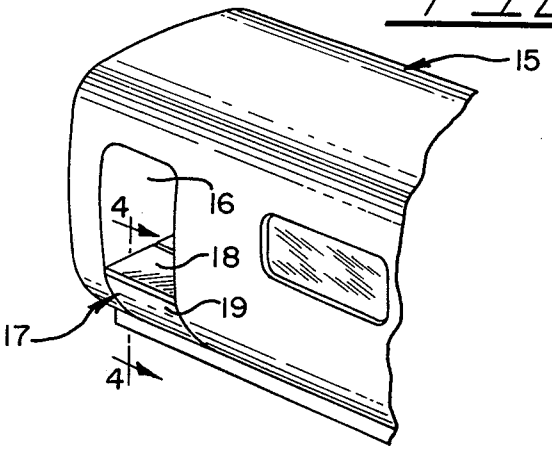
FIG. 1 is a fragmentary perspective view of one end of a transit vehicle with an opening for the loading and unloading of passengers with the platform in lower position and the steps in raised position.
Figure 2:
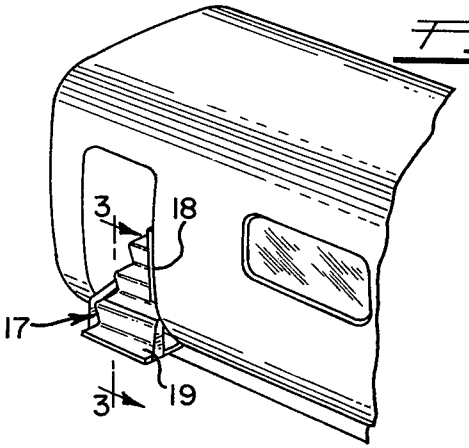
FIG. 2 is a view similar to FIG. 1 but with the platform in raised position and the steps in lower position.

Fragmentary showings of transit vehicles or cars are illustrated in FIGS. 1 and 2 and include the present invention showing the step and platform assembly in the closed position in FIG. 1 for the loading and unloading or passengers at a high level and in the open position in FIG. 2 for the loading and unloading of passengers at a low level. The transit vehicle illustrated is generally indicated by the numeral 15 and provided at one end thereof with an opening 16 which may be opened and closed by a conventional single or double door arrangement as is well known in the art. The step and platform assembly of the present invention is generally designated by the numeral 17 and shown at the bottom of the opening 16 and which includes a platform 18 and a step 19. The platform is shown in down or closed position in FIG. 1 and in up or open position in FIG. 2, while the step is shown in up or closed position in FIG. 1 and in down or open position in FIG. 2. Accordingly, it will be readily understood that the step-platform operator of the present invention will drive the step and platform between the closed positions shown in FIG. 1 and the open positions shown in FIG. 2 to respectively accomodate high and low level loading and unloading of passengers.

A first embodiment of the invention is illustrated in FIGS. 3 to 8, while a second embodiment of the invention is illustrated in FIGS. 9 to 12. Both embodiments utilize the weights of the step and platform to counterbalance each other during their movements between open and closed positions. The embodiment of FIGS. 9 to 12 essentially differs from the embodiment of FIGS. 3 to 8 by providing counterbalancing springs to assist in the ease and smooth operation of the operator and to even further enable the use of a smaller reversible gear motor. Further, details of the embodiment in FIGS. 9 to 12 will be explained hereafter.

The counterbalancing action of the step and platform may be quickly appreciated when it is seen that the operator functions to initially raise the platform while the step remains stationary. The step is then lowered while the platform continues to rise to an open position. Additionally, it will be appreciated that the linkage which is interconnected between the step and platform, is structured to further enhance the counterbalancing action between the step and platform.

Referring now particularly to FIGS. 5 to 8, it will be recognized that reference herein to the step 19 concerns only a portion of the entire step assembly and specifically that portion which is movable. A stationary step portion 22 is provided which is supported in the compartment for the step and platform operator between opposed vertically extending walls 23 of which only one is illustrated for purposes of clarity, it being appreciated that another like wall would be in parallel spaced relation and both walls would be oriented perpendicularly to the long axis of the vehicle. Further, it will be appreciated that the step and platform assembly 17 is not only supported between the opposed walls 23 but also by a rear vertically extending wall 24 which is at right angles to the walls 23 and an upper longitudinally extending support channel 25.

The step 19 is mounted on a step shaft 28 that is suitably supported between the walls 23 for rotational movement. Thus, the step shaft is generally parallel to the long axis of the vehicle. Opposed support members 29 and the step configuration 30 define the step 19 together with an outer wall portion 31. The outer wall portion 31, when in closed position as shown in FIG. 4, forms an extension of a stationary outer wall section 32 to collectively enclose the chamber or compartment within which the step and platform operator is located. Thus, rotation of the step shaft 28 between the positions shown in FIGS. 3 and 4 will move the step 19 from the open position shown in FIG. 3 to the closed position shown in FIG. 4.

The platform 18 is fixed to the platform shaft 36 which is suitably supported in a location above the step shaft 28 and mutually perpendicular thereto. While not shown, it may be appreciated that suitable brackets may be provided from the vehicle structure and particularly the wall 23 for rotatably supporting the platform shaft 36. Support members 37 are directly connected to the platform shaft 36 and onto which the platform plate 38 would be connected. A fragmentary portion of the platform 18 is shown in solid lines in FIG. 5 with the platform in raised or open position, while it is also shown in dotted lines in closed or down position.

The platform 18 and step 19 are driven between open and closed positions by a reversible drive gear motor 42 and a linkage consisting of levers and connecting rods. It will be appreciated that the gear motor 42 will be of the usual electrical type used in transit vehicle door operators although other drive motors such as hydraulic or pneumatic could be used. Power ratings should be compatible with the needs for the forces necessary to drive the platform and step between open and closed positions. Suitable controls operated by a conductor on the vehicle will effect operation of the motor 42. Since these controls do not form a part of the invention, they are not further disclosed herein.

The gear motor 42 is suitably mounted on the rear vertical wall 24, and it includes a gear motor output shaft 43 which extends parallel to the step shaft 28 and is mutually perpendicular to the platform shaft 36. A gear motor output level 44 is carried on the output shaft 43 and rotatable therewith as seen particularly in FIG. 5. The output lever 44 has an offset portion to which is secured one end of a connecting rod 45. The other end of the connecting rod 45 is connected to a main idler lever 46 of a main idler assembly 47.

The main idler lever 46 is carried on and rotatable on a main idler shaft 48 through a hub 49 which is rotatably carried on the shaft 48. The main idler lever 46 drives the step shaft through a connecting rod 50 connected at one end to the main idler step lever and at the other end to a step shaft lever 51 which is carried on the step shaft 28. It will be appreciated that the ends of the connecting rods 45 and 50 are pivotally connected to their respective levers with self-aligning rod ends.

Figures 3, 7:
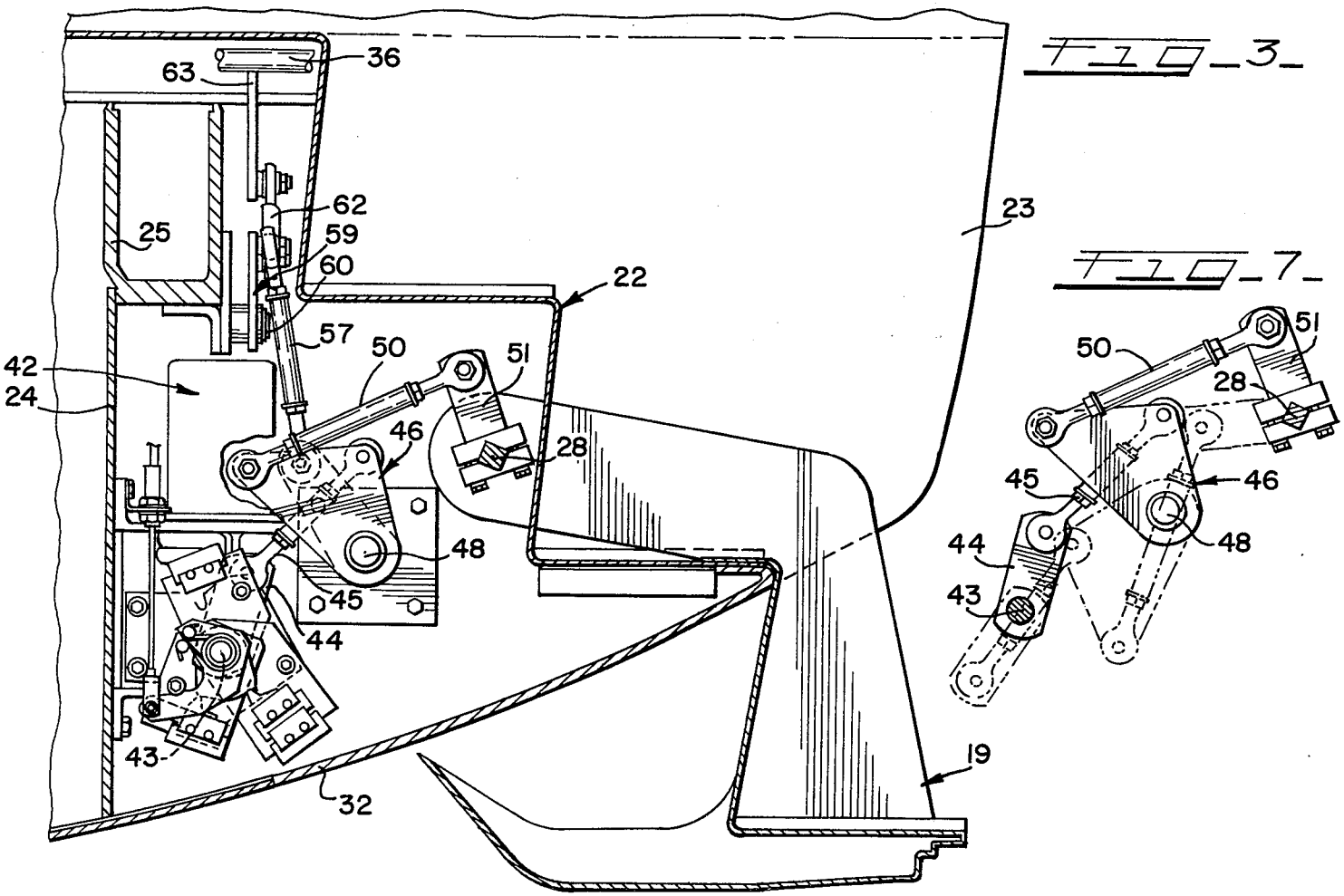
FIG. 3 is a transverse sectional view taken through the step-platform operator of the invention and particularly along lines 3—3 of FIG. 2 and illustrating the parts in the position where the platform is raised or in the up position and the movable portion of the steps are in the lower or down position.
FIG. 7 is a vertical sectional view taken through the step-platform operator of the invention and substantially along line 7—7 of FIG. 5.
Figures 4, 6, 8:
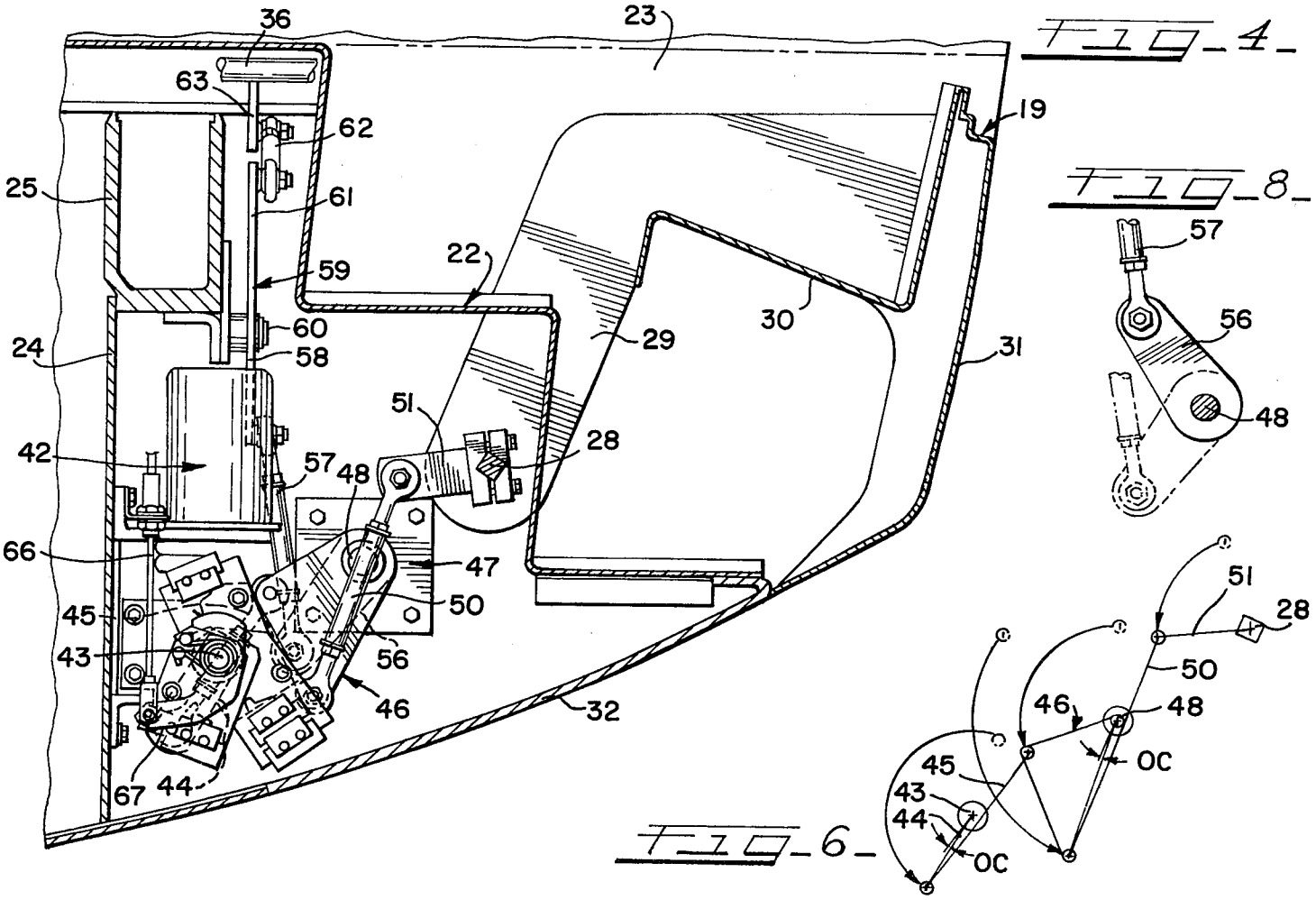
FIG. 4 is a view similar to FIG. 3 but taken along line 4—4 of FIG. 1 and illustrating the parts of the step and platform operator in the position where the step and platform are closed.
FIG. 6 is a diagrammatic view of the linkage of the step-platform operator of the invention for illustrating the overcenter locking actions of the step-platform operator.
FIG. 8 is a detailed sectional view of a part of the step-platform operator mechanism and taken particularly along line 8—8 of FIG. 5.
Figure 9:
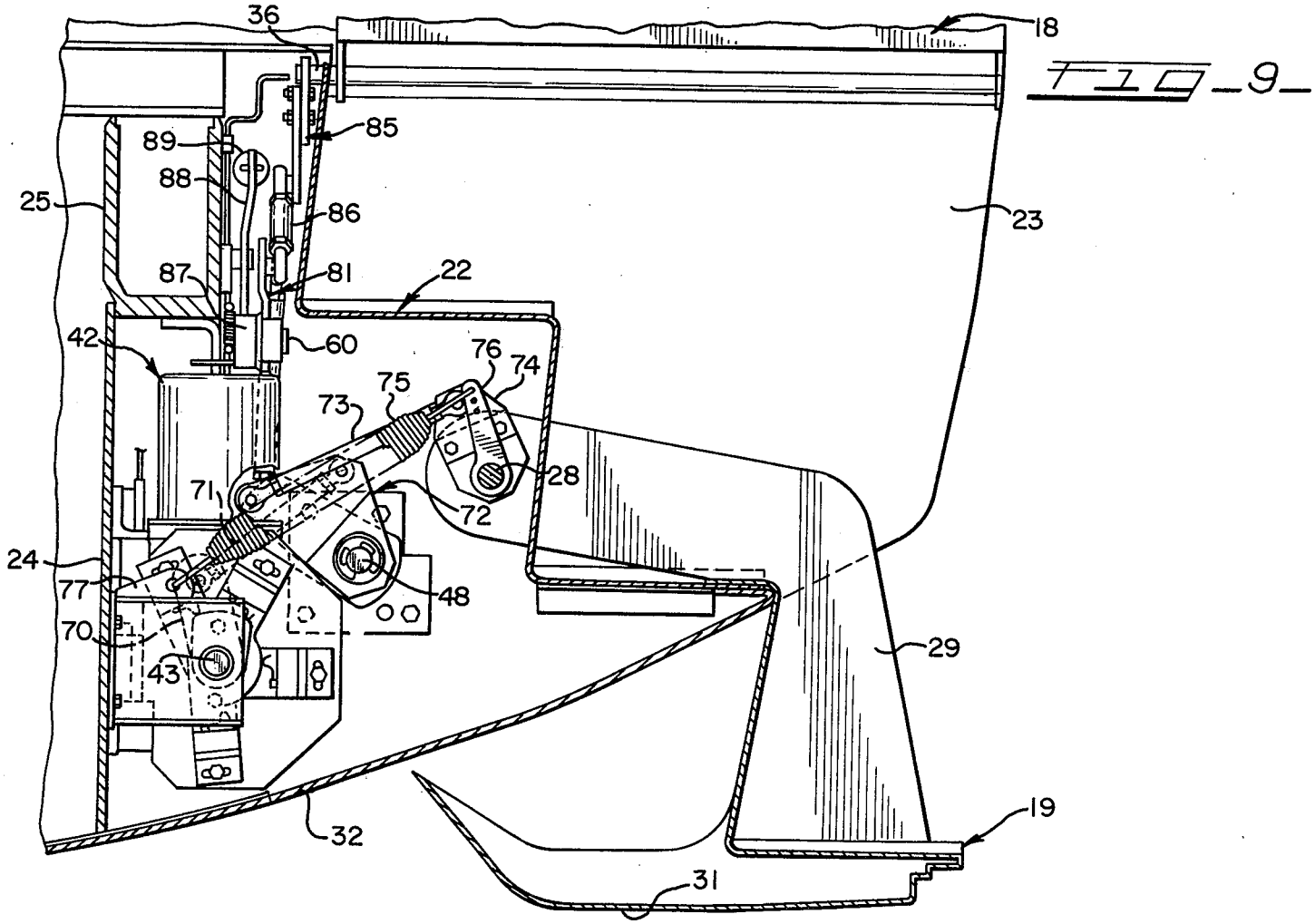
Figure 10:
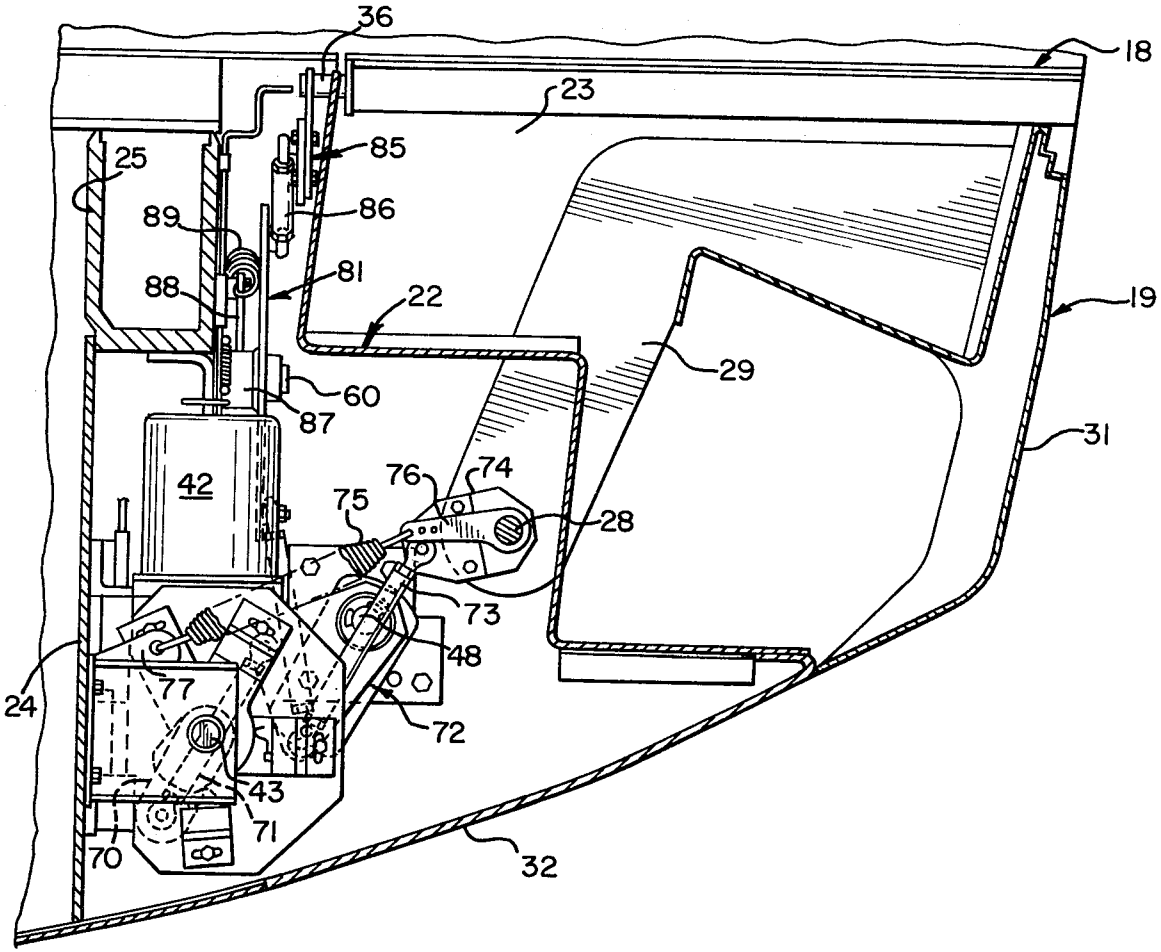
Figure 11:
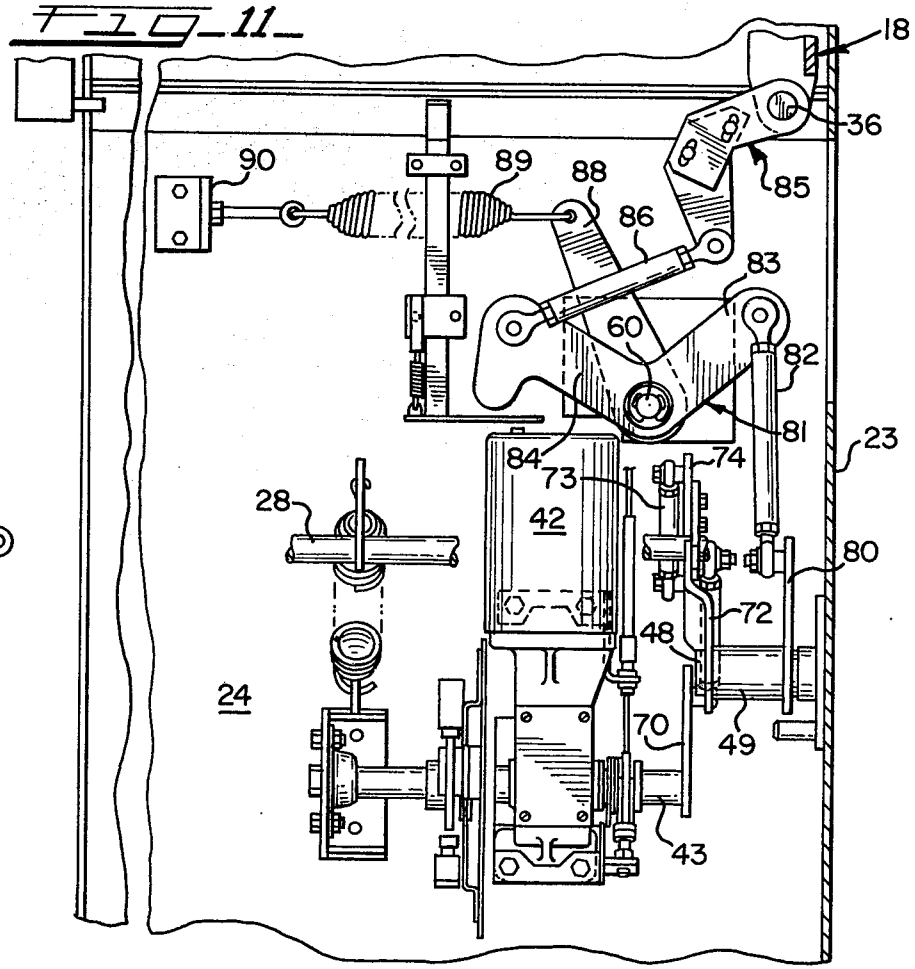
Figure 12:
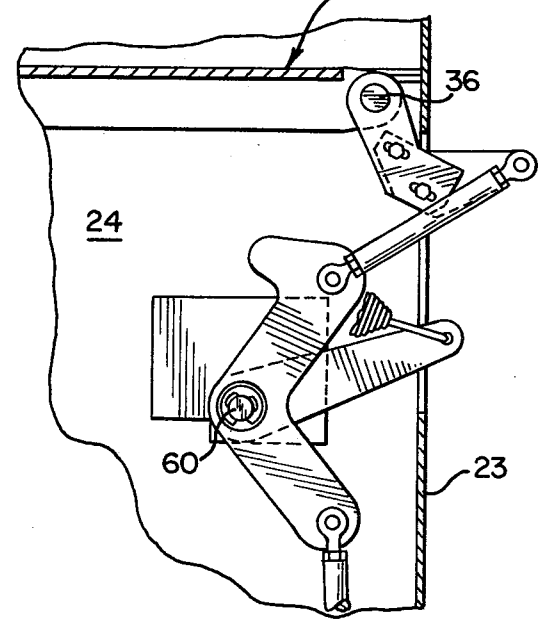

It can thereby be appreciated that rotation of the gear motor output shaft 43 will cause rotation of the step shaft whereby driving the output shaft in one direction will move the step 19 to its open position and reversing the rotation of the output shaft will thereafter drive the step into its closed position, particularly as viewed in FIGS. 3 and 4. Rotation of the output shaft 43 in a clockwise direction will cause opening of the step, while rotation of the shaft in a counterclockwise direction will cause closing of the step.

Figure 5:
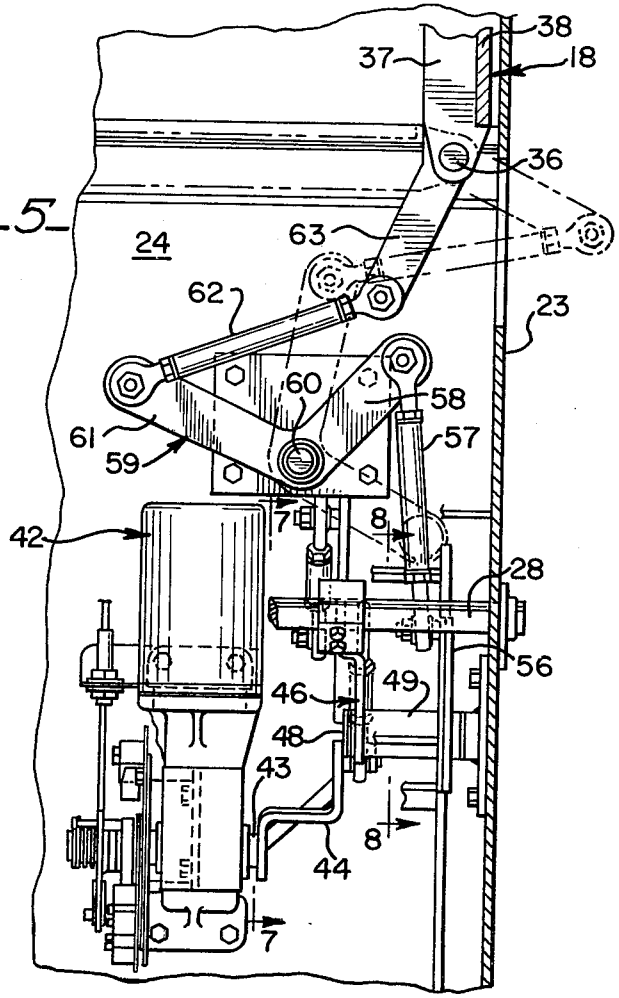
FIG. 5 is a partial front elevational view of the step-platform operator of the invention illustrated in the previous views and showing in solid lines the positions of the mechanism when the step and platform are in open position and in dotted lines when the step and platform are in closed positions.

A driving force is transmitted to the platform shaft 36 from the main idler hub 49 through the main idler platform lever 56 which is mounted on and rotatable with the main idler hub 49 and in spaced relation from the main idler step lever 46. A connecting rod 57 is connected at one end to the main idler platform lever 56 and at the other end to the input crank lever arm 58 of the crank lever 59. The crank lever 59 is rotatable on a crank lever shaft 60 supported on the channel member 25. The step shaft crank lever also includes an output crank lever arm 61 connected at one end to a connecting rod 62. The connecting rods 57 and 62 have self-aligning rod ends like the connecting rods 45 and 50. The other end of the connecting rod 62 is connected to a platform lever 63 which is fixed to the platform shaft 36. Rotation of the platform lever 63 effects rotation of the platform shaft 36 and the platform 18 which thereby moves between its up and down positions. Thus, movement of the main idler platform lever 56 during rotation of the main idler hub 49 causes rotation of the platform shaft 36 through the connecting rod 57, the crank lever 59, the connecting rod 62 and the platform lever 63. Specifically, rotation of the gear motor ouput shaft 43 in a clockwise direction causes rotation of the hub 49 on the shaft 48 in a clockwise direction and swinging of the main idler platform lever 56 upwardly to drive the platform shaft 36 as seen in FIG. 5 in a clockwise direction to raise the platform to its upper position. Thus, the step 19 and the platform 18 will be driven between their open and closed positions through operation of the reversible drive gear motor 42.

It may be appreciated that the crank lever shaft 60 is mutually perpendicular to the main idler shaft 48 and the gear motor output shaft 43. Additionally, the crank lever shaft 60 is parallel to the platform shaft 36.

In operation with the platform in the up or open position and the step in the down or open position energization of the reversible drive gear motor rotates the gear motor output lever which in turn rotates the main idler platform lever 46 and the main idler step lever 56. It will be noted that the connecting rod 50 approximately forms a 90 degree angle with the step shaft lever 51 to provide a greater mechanical advantage for ease of operation. The rotation of the main idler lever 56 turns the step shaft lever 46 and the step shaft 28 to commence movement of the step 19 from its open position toward is closed position. At the same time, rotation of the main idler platform lever 56 turns the crank lever 59 through connecting rod 57 which thereby moves the platform 18 through the connecting rod 62 and the platform lever 63 to commence moving the platform 18 from its up or open position to its down or closed position. Therefore, when the step 19 commences rising or moving toward closed position, the platform 18 commences lowering or moving toward the down or closed position which provides a gravitation counterbalancing effect. Thus, the weights of the platform and the step, while not necessarily being equal, will provide a gravitational counterbalancing effect as they move from their open to their closed positions. Similarly, in reverse, when the platform and step move from the closed positions to the open positions, the gravitational counterbalancing effect will be achieved. As best shown in FIGS. 6 and 7, when the step 19 reaches the near fully closed position, the linkage between the main idler lever 46 and the step shaft level 51 approach the dead center zone within which the rotation of the step shaft 28 is minimized. Meanwhile, the transition kinematics between the main idler platform lever 56, the crank lever 59 and the platform lever 63 is kept at a greater platform displacement region.

During the last portion of the closing cycle, rotation of the main idler lever 46 approximately six degrees before and after dead center as related to a plane extending through the pivot points of the levers and the idler shaft, the step shaft lever 51 generates practically no rotation. However, during this approximately twelve degrees of motion of the main idler lever 46, main idler platfrom lever 56, crank lever 59, and platform lever 63, not being in the dead center zone, will generate appreciable amount of platform (18) displacement. This allows differential motion between the step 19 which is essentially stationary and the platform motion during the last part of the closing cycle. This produces a non-interfacing mechanical interlock between the step and the platform in the fully closed position.

When both the step and the platform are almost in closed position, the gear motor output lever 44 forms an additional position overcenter lock with the main idler lever 46. The overcenter locking action between the main idler lever 46 and the step shaft lever 51 provides an independent locking action and support against the step weight. The overcenter locking action is best understood by reference to the diagrammatic illustration of the appropriate levers and connecting rods shown in FIG. 6. In the closed position, it can be seen that the connecting rod 50 between the step shaft lever 51 and the main idler shaft lever 46 moves across the center of the main idler shaft 48 to provide an overcenter locking action. Similarly, the connecting rod 45 between the main idler shaft lever 46 and the operator output shaft lever 44 moves overcenter of the operator output shaft 43 to provide an overcenter locking action. Thus a double overcenter locking action is provided by this linkage arrangement which further guards against unlocking of the mechanism when the step 19 and platform 18 are in closed position. As illustrated in FIG. 4, the weight of the step 19 acts toward the open position driving the main idler lever 46 to the home, or a more closed position against the step pin.

An emergency cable 66 is provided to break the overcenter locking action in the event of power failure to allow opening of the step and platform. It will be appreciated that the cable will extend to a position where an operator can apply a force on the cable to pull the cable and cause movement of the lever 67 to rotate the gear output shaft 43 in a direction to break the overcenter locking action to permit manual operation for opening the platform and step.

It may be further appreciated that additional controls will be provided which form no part of the invention and which serve to control the operation of the operator. For example, interlocks may be provided on the step to prevent raising of same while it is occupied by a passenger. Additionally, the usual number of limit switches would be utilized for limiting the gear motor travel. It can also be appreciated that interlocks may be provided in the control system for the platform step operator to prevent it from being operated when the vehicle is moving, if so desired.

While the embodiment of FIGS. 9 to 12 essentially differentiates from the embodiment of FIGS. 5 to 8 in the provision of counterbalancing springs to assist in easy and smooth operation and also to enable the use of a smaller horsepower gear motor, some of the parts appear to differ in form even though the general operation of this embodiment does not differ from the embodiment of FIGS. 5 to 8. Only selected numerals employed in the first embodiment will be used in this embodiment where there is such a relationship that identity of the parts are clearly the same. More specifically, the following parts or elements and the associated numerals previously used are applied to this embodiment: platform 18, step 19, stationary step portion 22, vertically extending support wall 23, vertical rear wall 24, longitudinally extending support channel 25, step shaft 28, opposed support members 29, outer wall portion 31, stationary outer wall section 32, platform shaft 36, reversible drive gear motor 42, gear motor output shaft 43, main idler shaft 44, main idler hub 49, and crank lever shaft 60. However, the terminology used to describe parts in the first embodiment will also be used where different numerals have been applied.

Drive assembly between the gear motor output shaft 43 and the step shaft 28 includes the gear motor output shaft lever 70 having one end of a connecting rod 71 pivotally secured thereto. The other end of the connecting rod 71 is pivotally connected to the main idler lever 72 carried on the hub 49. The connecting rod 72 is pivotally connected at one end to the main idler lever 72 and at the other end to the step shaft lever 74 which is secured to the step shaft 28. Thus, as in the first embodiment, rotation of the gear motor output shaft 43 will cause rotation of the step shaft 28 to drive the step 19 between open and closed positions. Additionally, to assist in raising the step 19, a counterbalancing spring 75 is attached at one end to an arm 76 connected to the step shaft 28 and at the outer end to a bracket 77 fastened to the rear vertical wall 24.

Also mounted on the hub 49 for rotation therewith to be driven by the gear motor 42 is a main idler platform lever 80 which is in turn connected to the platform crank lever 81 by a connecting rod 82. The crank lever 81 is essentially the same as the crank lever 59 in the first embodiment and is rotatably mounted on the crank lever shaft 60. In particular, the connecting rod 82 is connected to the input arm or leg 83 of the crank lever which also includes an output arm or leg 84 and is connected to the platform lever 85 through a connecting rod 86. The platform crank lever 81 is carried on a hub 87 that is rotatably mounted on the shaft 60 in a similar manner to the like parts in the first embodiment. Also carried on the hub 87 is a platform counterbalancing spring arm 88 which has connected thereto one end of the counterbalancing spring 89 utilized to counterbalance and help lift the platform 18 to its upper or open position. The other end of the counterbalancing spring 89 is fixed to a stationary bracket 90 that is mounted on the rear vertical wall 24. It will be noted that the platform lever 85 is constructed to provide an adjustment of its length for controlling the relation between the step shaft rotation and the rotation of the platform. Thus, the platform spring 89 serves to assist the final raising of the platform and is active only during the final raising movement of the platform on the opening stroke, this final movement being during which the platform traverses approximately the last 45 degrees of rotation to the vertical or raised position. Other than the additional forces generated by the counterbalancing springs 75 and 89, the operation of the step platform embodiment of FIGS. 9 to 12 is the same as the embodiment of FIGS. 3 to 8.

Thus, the counterbalancing springs are utilized to complement the forces generated by the gear motor, which assists the motor to operate at nearly constant torque or horsepower. Therefore, a relatively low power drive motor can be used since the stored spring force aids the motor at peak torque requirements. The platform spring 89, being active only during the final portion of the platform opening or raising stroke, additionally prevents the platform from overtraveling and damaging the vestibule.

It will be understood that modifications and variations may be effected without departing from the scope of the novel concepts of the present invention, but it is understood that this application is to be limited only by the scope of the appended claims.

I claim:

1. In a transit vehicle having an opening for high and low level loading and unloading of passengers, a step and platform assembly at the bottom of the opening having a step rotatable along one axis between an open or down position and a closed or raised position and a platform rotatable along an axis mutually perpendicular to said one axis and between an open or raised position and a closed or down position, whereby said step is usable for low level loading and unloading of passengers when the step is in the open or down position and the platform is in open or raised position while said platform is usable for high level loading and unloading of passengers when the platform is in the closed or down position and the step is in closed or raised position, the improvement in a step-platform operator for simultaneously moving said step between closed and open positions and said platform between closed and open positions, said operator including a reversible drive motor having a rotatable output shaft, and drive means interconnecting the drive motor and the step and interconnecting the drive motor and the platform to utilize the weights of the step and platform to counterbalance each other during movement thereof between said positions, said drive means having a lever and connecting rod assembly which transmits the rotatable force of the output shaft to the step and platform, and said lever and connecting rod assembly including a main idler lever assembly having a step idler lever and a platform idler lever rotatably mounted on an idler shaft, a drive motor output lever on the output shaft connected to the step idler lever and the platform idler lever, a step lever connected to the step and in turn connected to the step idler lever, said idler shaft being parallel to said drive motor output shaft, a crank lever having a pair of arms and being rotatably mounted on a shaft mutually perpendicular to the idler shaft, one of said arms being connected to the platform idler lever, and a platform lever connected to the platform and said other of said arms.

2. The step-platform operator defined in claim 1, wherein said drive means further includes overcenter locking means to lock the step and platform in closed positions when the motor is de-energized.

3. The step-platform operator defined in claim 1, wherein said drive means further includes spring means to assist movement of said step and platform during peak torque requirements of the drive motor.

4. In a transit vehicle having an opening for high and low lever loading and unloading of passengers, a step and platform assembly at the bottom of the opening having a step mounted on a shaft and rotatable therewith between open or lowered and closed or raised positions and a platform mounted on a shaft and rotatable therewith between open or raised and closed or lowered positions, said platform shaft being mutually perpendicular to said step shaft, whereby said step is usable for low level loading and unloading of passengers when in the lowered position with the platform in the raised position while said platform is usable for high lever loading and unloading of passengers when in the lowered position with the step in the raised position, the improvement in a step-platform operator for simultaneously driving said step from its closed position to its open position and the platform from its closed position to its open position, said operator including a reversible drive motor having a rotatable output shaft, and a lever and linkage assembly interconnecting said output shaft to said step and platform shafts, said lever and linkage assembly having an overcenter lock to lock the step in closed or raised position when the drive motor is deenergized, said lever and linkage assembly further including a main idler assembly having lever means connected to the output shaft and rotatable on an axis parallel to the output shaft axis, means connecting the lever means to said step shaft, and a crank lever rotatable on an axis perpendicular to the axis of the lever means axis and parallel to the platform shaft axis and connected to both the lever means and the platform shaft.

5. The step-platform operator defined in claim 4, wherein the lever and linkage assembly drives the step and platform such that the weights thereof counterbalance one another during movement between positions.

6. The step-platform operator defined in claim 5, wherein the lever and linkage assembly further includes spring means for assisting the drive motor to provide equal torque throughout the opening and closing strokes of the step and platform.

7. The step-platform operator defined in claim 6, wherein the spring means includes a counterbalancing step spring applying a force to the step shaft and a counterbalancing platform spring applying a force to the platform shaft.

8. The step-platform operator defined in claim 7, wherein the step spring force applies a closing force to the step and the platform spring force applies an opening force to the platform.

* * * * *

UNITED STATES PATENT AND TRADEMARK OFFICE

CERTIFICATE OF CORRECTION

PATENT NO. : 4,275,664

DATED : June 30, 1981

INVENTOR(S) : Redreddy S. Reddy

It is certified that error appears in the above-identified patent and that said Letters Patent are hereby corrected as shown below:

In the Title: Change "OPERATION" to --OPERATOR--;

Col. 1, Title: Change "OPERATION" to --OPERATOR--;

Col. 3, line 15, change "or" to --of--;

Signed and Sealed this

*Twentieth* Day of *October 1981*

[SEAL]

*Attest:*

GERALD J. MOSSINGHOFF

*Attesting Officer*

*Commissioner of Patents and Trademarks*